United States Patent [19]

Russell

[11] Patent Number: 4,958,837

[45] Date of Patent: Sep. 25, 1990

[54] TRAVEL GAME WITH A GAME BOARD DISPLAY SCREEN AND ELECTRONIC CARD READER

[76] Inventor: Faye Y. Russell, 1642 E. 84th St., Chicago, Ill. 60617

[21] Appl. No.: 369,738

[22] Filed: Jun. 23, 1989

[51] Int. Cl.[5] ..... A63F 3/00; A63F 9/18

[52] U.S. Cl. ..... 273/237; 273/1 E; 273/252; 273/DIG. 28; 273/138 R

[58] Field of Search ..... 273/237, 251-254, 273/1 E, 85 G, 138 R, DIG. 28; 434/128, 129, 130, 150, 153, 323, 311

[56] References Cited

U.S. PATENT DOCUMENTS

| | | | |
|---|---|---|---|
| 707,469 | 8/1902 | Wayts | 273/254 |
| 3,638,946 | 2/1972 | Bain | 273/254 |
| 4,061,336 | 12/1977 | Lincoln | 273/254 |
| 4,109,917 | 8/1978 | Hatcher | 273/254 |
| 4,290,607 | 9/1981 | McDonald | 273/239 |
| 4,326,719 | 4/1982 | Tran et al. | 273/238 |
| 4,511,143 | 4/1985 | Sankyithi | 273/153 R |
| 4,629,195 | 12/1986 | Charney | 273/254 |
| 4,679,798 | 7/1987 | Dvorak et al. | 273/254 |
| 4,840,382 | 6/1989 | Rubin | 273/237 |

FOREIGN PATENT DOCUMENTS

| | | | |
|---|---|---|---|
| 1604561 | 12/1981 | United Kingdom | 273/254 |
| 2127201 | 4/1984 | United Kingdom | 434/128 |
| 2205254 | 12/1988 | United Kingdom | 273/254 |

*Primary Examiner*—Benjamin Layno

*Attorney, Agent, or Firm*—Jerry T. Kearns

[57] ABSTRACT

A travel game includes a display screen connected to a programmed controller for producing geographic map displays of various geographic regions. The program controller is operative to indicate travel routes on the display between various origin and destination display points. The display routes may include alternative routes for use by different travel modes such as vehicle, rail and air. Individuals move game marker pieces along selected travel routes in accordance with randomly determined movement increments and accumulate time and score awards and penalties according to encountered travel route obstacles and their success in correctly answering questions regarding travel route landmarks. The questions may be posed by a group of cards having bar code indicia representing time and score awards and penalties for tabulation by an electronic score keeping computer having a bar code reader. The score keeping computer includes a plug connection for interface with the programmed display controller allowing a rated average score for a player to be determined based upon selection of travel routes and a player's successful travel.

8 Claims, 4 Drawing Sheets

TRAVEL GAME WITH A GAME BOARD DISPLAY SCREEN AND ELECTRONIC CARD READER

BACKGROUND OF THE INVENTION

1. Field of the Invention

The present invention relates to travel games, and more particularly pertains to travel game utilizing an electronic display and a programmed controller for displaying maps of various geographic regions. Various types of board type travel games are known in the prior art which utilize a race track type movement format in conjunction with game play pieces. These conventional board games are uninspiring and inadequately diverse to hold an individual's attention for any length of time. Additionally, the limited format of these conventional board games does not make full use of the educational potential of a travel type game. In order to overcome these problems, the present invention provides a travel type game utilizing a display and a programmable controller for both entertaining and educating game players.

2. Description of the Prior Art

Various types of travel games are known in the prior art. A typical example of such a travel game is to be found in U.S. Pat. No. 4,061,336, which issued to L. Lincoln on Dec. 6, 1977. This patent discloses a travel game having a puzzle map of the United States with removable states on the playing surface. Tokens reflecting different modes of travel are used to represent a player's position in making trips between various states. Spinners are used to randomly determine a player's travel mode and move length. U.S. Pat. No. 4,109,917, which issued to S. Hatcher on Aug. 29, 1978, discloses a game simulating trucking activities which utilizes simulated citizen's band radio communications and chance movement of player pieces in traversing a game board. U.S. Pat. No. 4,290,607, which issued to G. McDonald on Sept. 22, 1981, discloses a travel game utilizing a game board and a plurality of card sets each bearing instructions thereon for the advance of game play. U.S. Pat. No. 4,629,195, which issued to F. Charney on Dec. 16, 1986, discloses a travel game including a game board having indicia designating various locales. The game utilizes a plurality of stackable time pieces which indicate the game time and a plurality of business establishment coupons associated with various zones on the board. U.S. Pat. No. 4,679,798, which issued to R. Dvorak et al on July 14, 1987, discloses a travel game utilizing a game board and game playing pieces. Various travel routes are indicated on the game board and movement of playing pieces is determined randomly by dice.

While the above mentioned devices are directed to travel games, none of these games utilize a display and a programmable controller to display maps of a wide variety of different geographic regions. Additionally, none of the aforesaid mentioned travel games utilize a programmed electronic display format in conjunction with travel landmark questions to entertain and educate game players. Inasmuch as the art is relatively crowded with respect to these various types of travel games, it can be appreciated that there is a continuing need for and interest in improvements to such travel games, and in this respect, the present invention addresses this need and interest.

SUMMARY OF THE INVENTION

In view of the foregoing disadvantages inherent in the known types of travel games now present in the prior art, the present invention provides an improved travel game. As such, the general purpose of the present invention, which will be described subsequently in greater detail, is to provide a new and improved travel game which has all the advantages of the prior art travel games and none of the disadvantages.

To attain this, representative embodiments of the concepts of the present invention are illustrated in the drawings and make use of a travel game including a display screen connected to a programmed controller for producing geographic map displays of various geographic regions. The program controller is operative to indicate travel routes on the display between various origin and destination display points. The display routes may include alternative routes for use by different travel modes such as vehicle, rail and air. Individuals move game marker pieces along selected travel routes in accordance with randomly determined movement increments and accumulate time and score awards and penalties according to encountered travel route obstacles and their success in correctly answering questions regarding travel route landmarks. The questions may be posed by a group of cards having bar code indicia representing time and score awards and penalties for tabulation by an electronic score keeping computer having a bar code reader. The score keeping computer includes a plug connection for interface with the programmed display controller allowing a rated average score for a player to be determined based upon selection of travel routes and a player's successful travel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved travel game which has all the advantages of the prior art travel games and none of the disadvantages.

It is another object of the present invention to provide a new and improved travel game which may be easily and efficiently manufactured and marketed.

It is a further object of the present invention to provide a new and improved travel game which is of a durable and reliable construction.

An even further object of the present invention is to provide a new and improved travel game which is susceptible of a low cost of manufacture with regard to both materials and labor, and which accordingly is then susceptible of low prices of sale to the consuming public, thereby making such travel games economically available to the buying public.

Still yet another object of the present invention is to provide a new and improved travel game which provides in the apparatuses and methods of the prior art some of the advantages thereof, while simultaneously overcoming some of the disadvantages normally associated therewith.

Still another object of the present invention is to provide a new and improved travel game having a display connected to a programmable controller for displaying maps of various different geographic regions.

Yet another object of the present invention is to provide a new and improved travel game utilizing various travel landmark questions during game play to educate and entertain game players.

Even still another object of the present invention is to provide a new and improved travel game utilizing a programmable controller in conjunction with an electronic display to afford an extremely diverse travel game format.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
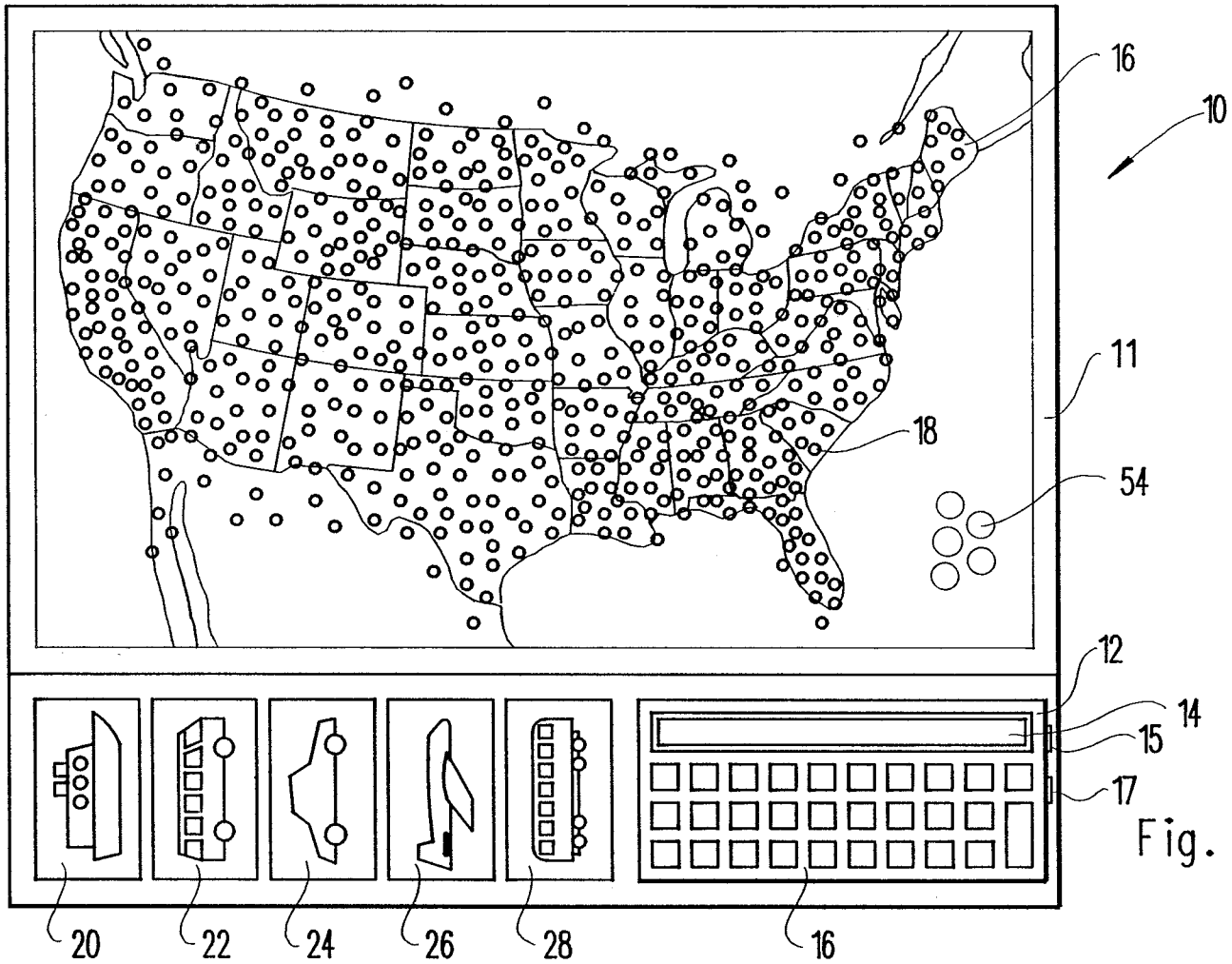
FIG. 1 is a plan view illustrating the game display and programmed controller.

With reference now to the drawings, and in particular to FIG. 1 thereof, a new and improved travel game embodying the principles and concepts of the present invention and generally designated by the reference numeral 10 will be described.

More specifically, it will be noted that the first embodiment 10 of the invention includes a rectangular housing having a major portion formed by an electronic flat display screen. Various types of conventional displays may be utilized, for example LCD type or twisted crystal displays. CRT type displays may also be employed, without departing from the scope of the present invention. A programmed controller 16 is provided on a lower corner portion 12 of the housing and includes an LCD type display 14 for indicating keyboard entry and communicating instructions to game players. A plurality of card stations 20, 22, 24, 26 and 28 are designated for the reception of groups of various different travel mode cards. Example travel modes are by ship 20, by bus 22, by automobile 24, by airplane 26, and by train 28. The programmed controller 16 includes interface plug jacks 15 and 17 for connection with a score keeping computer to be subsequently described. The programmed controller 16 utilizes a conventional micro-processor in combination with ROM memory to display a variety of maps of different geographic regions. Preferably, a menu type format is utilized to enable players to select and display a map of a particular geographic region. Included in each map is a display of a variety of different travel routes designated by circles 18. While circles 18 are depicted, it should be understood that a variety of different symbols or indicia may be utilized to designate the travel routes, and different alternative routes are indicated by different indicia or by appropriate shading.

Figure 2:
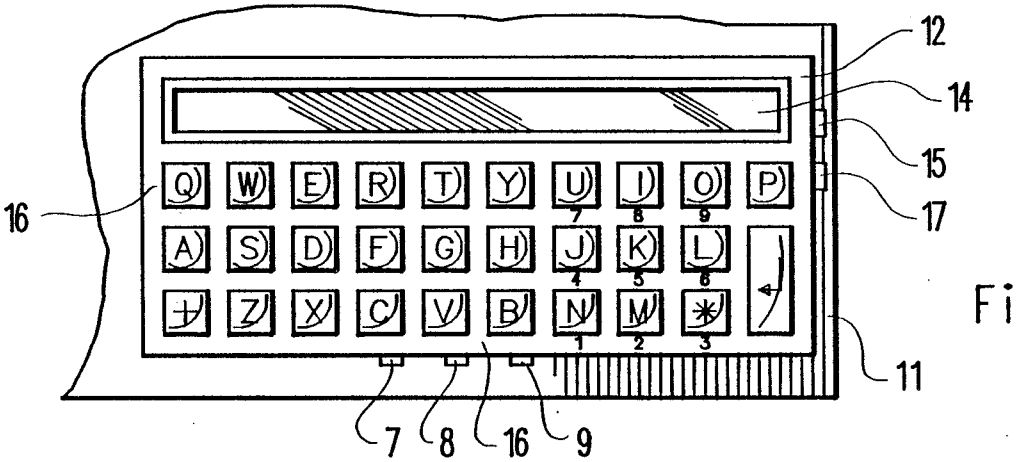
FIG. 2 is a detail view further illustrating the programmed controller.
Figures 3, 4, 5, 6, 7:
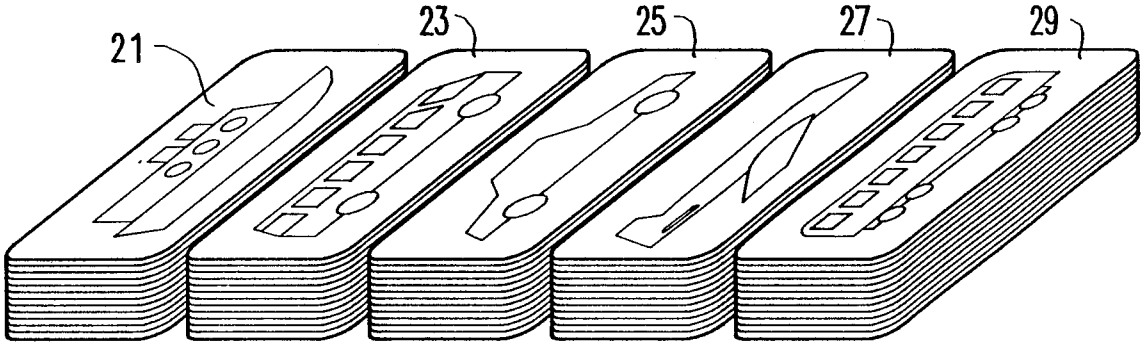
FIGS. 3 through 7 are perspective views illustrating groups of various different travel mode cards.

As illustrated in the detail view of FIG. 2, the controller 16 includes a conventional keyboard entry system and a plurality of function switches 7, 8 and 9.

FIGS. 3 through FIG. 7 illustrates 5 different groups of travel card sets 21, 23, 25, 27 and 29, corresponding respectively with the card zones 20, 22, 24, 26 and 28.

Figure 8:
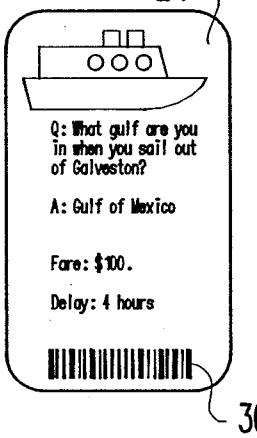
FIGS. 8 through 12 each illustrate a face of an example travel mode card.
Figure 9:
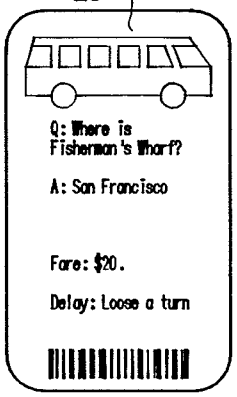
Figure 10:
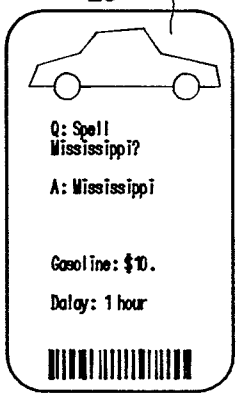
Figure 11:
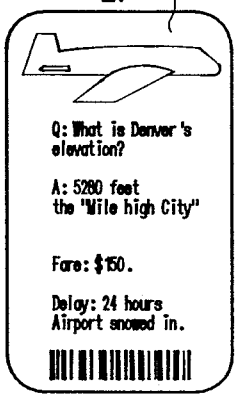
Figure 12:
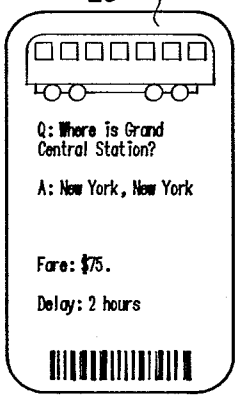

FIGS. 8 through 12 illustrate indicia provided on a front face of the travel mode cards 21, 23, 25, 27 and 29. As shown in FIG. 8, each card may also include a bar code indicia 30 representing a score and time award or bonus associated with a particular card. Each of the travel mode cards has a question regarding a travel route landmark. It is contemplated that score keeping will involve a combination of a score indicated by a dollar amount and an accumulated time indicating travel time and delays. The resulting score is calculated as a weighted average function of the dollar and time perimeters. As an alternative to the use of travel mode cards, the programmed controller 16 illustrated in FIG. 1 may include ROM memory storing a variety of questions and corresponding answers associated with a particular selected travel route. Upon keyboard entry of a player selected route, the controller will pose a question relevant to a player's particular locale along the travel route.

Figure 13:
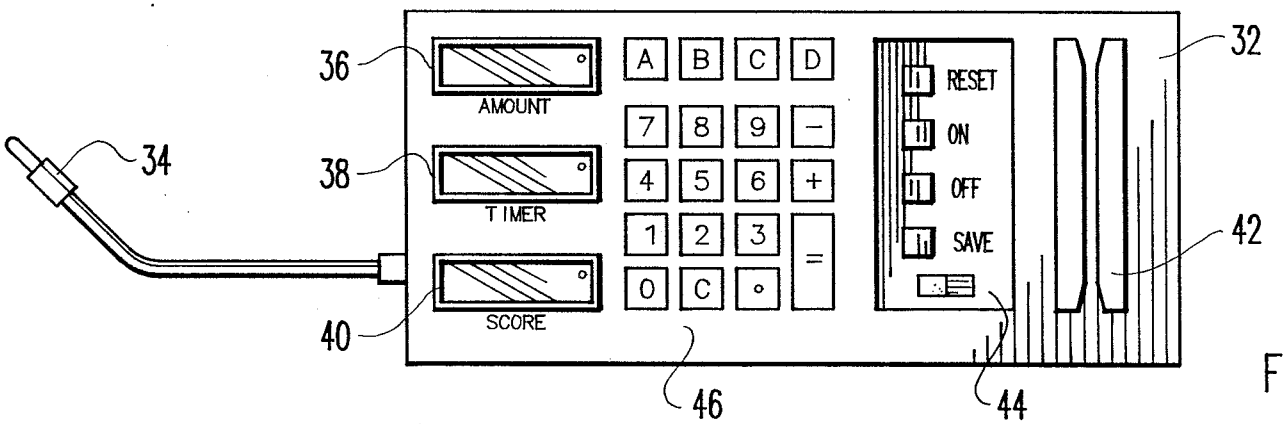
FIG. 13 is a plan view illustrating an electronic score keeping computer.

FIG. 13 illustrates a score keeping computer 32 which may be utilized to tabulate and calculate a player's weighted average score. The computer 32 utilizes a conventional microprocessor and associated memory to display a particular player's remaining dollar account balance in an electronic display 36 and a player's accumulated travel time in a similar display 38. A particular player's weighted average score is displayed in an additional display 40. A calculator type keypad 46 may be used to input dollar and time awards and penalties and function keys A, B, C, and D may be utilized to toggle between memories for each particular player. The score keeping computer 32 includes a plug connection 34 for connection with the jacks 15 and 17 of the programmed controller 16 illustrated in FIG. 1. The bar code reader 42 on the score keeping computer 32 is utilized to input awards and penalties from the bar code indicia 30 as shown in FIG. 8.

Figure 14:
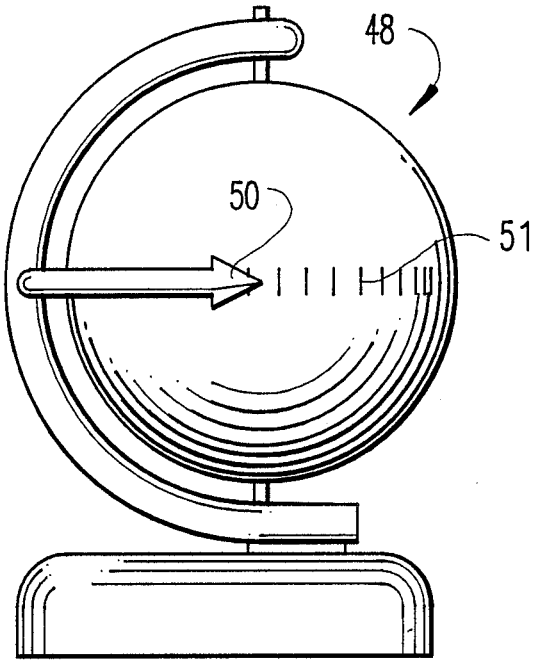
FIG. 14 is an elevational view illustrating a globe spinner for determining game piece movement.

FIG. 14 illustrates a rotationally mounted globe 48 having a stationary indicator 50 which cooperates with numerically increment scale 51 to designate a random number to determine a player's movement along a particular travel route. Alternatively, the programmed controller 16 illustrated in FIG. 1 may include a random number function for determining each player's movement length at each turn. While such electronic selection is possible, many players may find it preferable to utilize the globe 48 as providing a more exciting and graphic chance movement determination. Additionally, the globe 48 may include map indicia for further entertaining and educating game players by selecting travel origin and destination points.

Figure 15:
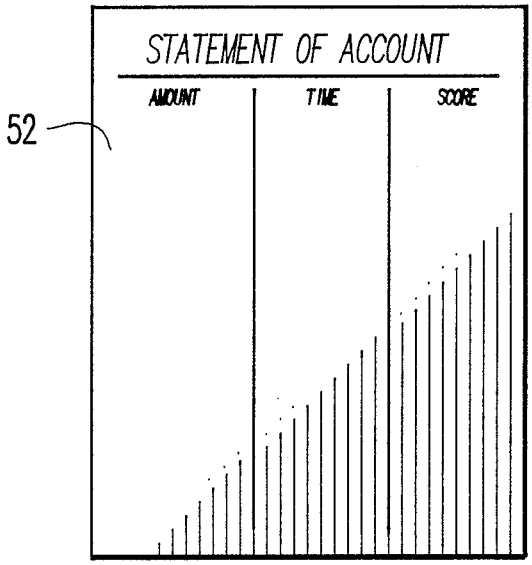
FIG. 15 is a plan view illustrating a score sheet utilized in an alternative manual score keeping method.

FIG. 15 illustrates a score sheet 52 which may be used as a manual alternative to the electronic score keeping computer 32 shown in FIG. 13.

With reference now to FIG. 1, the manner of the play of the present invention will now be described. Each game player initially selects a differently configured or colored marker 54 to mark their travel movement. A geographic region for play may be selected by the globe spinner 48 shown in FIG. 14 and through keyboard entry on the controller 16, the map of the particular geographic region is depicted on the display 11, along with various alternative travel routes designated by appropriate indicia 18. The players then randomly determine the first player who selects a particular starting point and destination. Alternatively, the starting point and designation may be randomly determined by the controller 16 or the globe spinner 48. In either case, the origin and destination is entered on the keyboard of the controller 16 and the available alternative travel routes are then highlighted by the controller on the display. By random determination, utilizing a random number function of the controller 16 or through the spinner illustrated in FIG. 14, a player then ascertains the permissible move length along a particular travel route. The player must then select the particular travel mode to be utilized from the displayed alternative routes and moves their particular playing piece the selected number of increments along the player's selected routes. Upon completion of movement, the player selects a travel mode card from one of the designated zones 20, 22, 24, 26, 28 corresponding with the travel mode selected. It is contemplated that a variety of card sets for each travel mode will be provided, corresponding with each particular geographic region. Upon selection of a travel mode card, an opposing player poses the question on the card face, as illustrated in FIGS. 8 through 12, and the active player attempts to correctly answer the question. Upon a player's correct answer of the question, the player will accumulate dollar score and or time awards. Upon incorrectly answering the question, the player is assessed a dollar score or time penalty. In either case, the award or penalty may be input to the score keeping computer 32 shown in FIG. 13 through the bar code reader 42 or through the keypad 46 for display on the displays 36, 38 and 40. As an alternative to the use of the travel mode cards, the controller 16 may include ROM memory storing question and answer lists for the various geographic regions and alternative travel routes. Upon completion of the initial player's turn, play continues sequentially among the remaining players. A game is completed when each player has reached their selected destination. The weighted average score is then determined from a predetermined formula and the winner ascertained. The game winner is determined from a combination of chance in determining game movement length and a player's skill or knowledge in answering travel landmark questions along with alternative travel route selection. In addition to the use of travel landmark questions and answers to determine awards and penalties, the program controller 16 may assign various obstacles and awards to particular alternative travel routes.

As may now be understood, the present invention provides an entertaining and educational travel game which uses a programmed controller to provide an extremely diverse game format encompassing both national and international travel in a wide variety of geographic regions. In addition to learning history and geography of various regions, game players become acquainted with obstacles and other experiences associated with various alternative travel routes and travel modes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A travel game, comprising:

display means;

programmed control means operatively connected to said display means for producing a geographic map display;

said programmed control means operative to display travel routes between selected geographic locations;

a plurality of groups of travel mode cards, each group of cards bearing indicia representing a different mode of travel;

game marker pieces for representing player travel movement along said travel routes;

a rotationally mounted globe having indicia representing movement increments for selection by a stationary indicator for randomly determining movement of said game marker pieces along said travel routes;

means for selecting travel route origins and destinations;

means for posing questions regarding travel route landmarks;

means for assessing time and score awards and penalties; and score keeping means for tabulating said time and score awards and penalties.

2. The travel game of claim 1, wherein said score keeping means comprises a score sheet having indicia designated entry zones for time and score totals.

3. The travel game of claim 1, wherein said means for selecting travel route origins and destination comprises a programmed control means.

4. The travel game of claim 1, wherein said means for posing questions regarding travel route landmarks comprises a programmed control means.

5. The travel game of claim 1, wherein said means for posing questions regarding travel route landmarks comprises a group of cards.

6. The travel game of claim 5, further comprising award or penalty indicating indicia on said group of cards.

7. A travel game, comprising:

display means;

programmed control means operatively connected to said display means for producing a geographic map display;

said programmed control means operative to display travel routes between selected geographic locations;

a plurality of groups of travel mode cards, each group of cards bearing indicia representing a different mode of travel;

game marker pieces for representing player travel movement along said travel routes;

means for randomly determining movement of said game marker pieces along said travel routes;

means for selecting travel route origins and destinations;

a group of cards for posing questions regarding travel route landmarks;

award or penalty indicating bar code indicia on said group of cards corresponding to awards associated with correct question answers and penalties associated with incorrect question answers;

a bar code reader operatively associated with said programmed control means for entering award or penalty data from said bar code indicia;

means for assessing time and score awards and penalties; and score keeping means for tabulating said time and score awards and penalties.

8. A travel game, comprising:

display means;

programmed control means operatively connected to said display means for producing a geographic map display;

said programmed control means operative to display travel routes between selected geographic locations;

a plurality of groups of travel mode cards, each group of cards bearing indicia representing a different mode of travel;

game marker pieces for representing player travel movement along said travel routes;

means for randomly determining movement of said game marker pieces along said travel routes;

means for selecting travel route origins and destinations;

a group of cards for posing questions regarding travel route landmarks;

award or penalty indicating bar code indicia on said group of cards corresponding to awards associated with correct question answers and penalties associated with incorrect question answers;

means for assessing time and score awards and penalties;

a programmed electronic computer including a bar code reader for entering award or penalty data from said bar code indicia; and means for operatively connecting said computer with said programmed control means for tabulating said time and score awards and penalties.

* * * * *